US012458196B2

(12) United States Patent
Eisenbart et al.

(10) Patent No.: US 12,458,196 B2
(45) Date of Patent: Nov. 4, 2025

(54) DOMESTIC DISHWASHER AND METHOD

(71) Applicant: BSH Hausgeräte GmbH, Munich (DE)

(72) Inventors: Bernd Eisenbart, Holzheim (DE); Dominik Veh, Finningen (DE)

(73) Assignee: BSH Hausgeräte GmbH, Munich (DE)

( * ) Notice: Subject to any disclaimer, the term of this patent is extended or adjusted under 35 U.S.C. 154(b) by 115 days.

(21) Appl. No.: 18/290,017

(22) PCT Filed: May 19, 2022

(86) PCT No.: PCT/EP2022/063518
§ 371 (c)(1),
(2) Date: Nov. 9, 2023

(87) PCT Pub. No.: WO2022/258337
PCT Pub. Date: Dec. 15, 2022

(65) Prior Publication Data

US 2024/0374109 A1 Nov. 14, 2024

(30) Foreign Application Priority Data

Jun. 11, 2021 (DE) ..... 102021205923.6

(51) Int. Cl.
*A47L 15/22* (2006.01)
*A47L 15/50* (2006.01)
*A47L 15/00* (2006.01)

(52) U.S. Cl.
CPC ..... *A47L 15/22* (2013.01); *A47L 15/505* (2013.01); *A47L 15/0063* (2013.01);
(Continued)

(58) Field of Classification Search
CPC .... A47L 15/505; A47L 15/22; A47L 2401/24; A47L 2501/20; A47L 15/0063; A47L 2401/30
See application file for complete search history.

(56) References Cited

U.S. PATENT DOCUMENTS 11,696,667 B2 * 7/2023 Eisenbart ..... A47L 15/22 134/56 D
12,042,112 B2 * 7/2024 Lugert ..... A47L 15/4204
(Continued)

FOREIGN PATENT DOCUMENTS

DE 102015225331 A1 6/2017
DE 102020123416 A1 3/2021
(Continued)

OTHER PUBLICATIONS

National Search Report DE 10 2021 205 923.6 dated Feb. 17, 2022.
IInternational Search ReportPCT/EP2022/063518 dates Aug. 30, 2022.

*Primary Examiner* — Benjamin L Osterhout
(74) *Attorney, Agent, or Firm* — Michael E. Tschupp; Andre Pallapies; Brandon G. Braun

(57) ABSTRACT

A household dishwasher includes a washware receptacle, a holding facility positioned in or on the washware receptacle to hold washware, an actively driven spray arm, and an open-loop and closed-loop control facility designed to influence a rotational movement of the spray arm as a function of a position of the holding facility in or on the washware receptacle so that the spray arm pauses close to the holding facility to apply wash liquor and/or fresh water to the washware held by the holding facility.

11 Claims, 6 Drawing Sheets

(52) U.S. Cl.
CPC ..... *A47L 2401/24* (2013.01); *A47L 2401/30* (2013.01); *A47L 2501/20* (2013.01)

(56) References Cited

U.S. PATENT DOCUMENTS

| | | | | |
|---|---|---|---|---|
| 2012/0031432 | A1 | 2/2012 | Beaudet | |
| 2013/0125936 | A1* | 5/2013 | Forster | A47L 15/22 134/198 |
| 2013/0139854 | A1 | 6/2013 | Lee | |
| 2013/0139860 | A1* | 6/2013 | Forster | A47L 15/23 134/198 |
| 2013/0284216 | A1* | 10/2013 | Forster | A47L 15/18 134/179 |
| 2016/0287047 | A1* | 10/2016 | Dreossi | A47L 15/4221 |
| 2016/0287050 | A1* | 10/2016 | Dreossi | A47L 15/4214 |
| 2016/0296097 | A1 | 10/2016 | Dreossi | |
| 2019/0290095 | A1* | 9/2019 | Wahlberg | A47L 15/23 |
| 2021/0259510 | A1* | 8/2021 | Durham | A47L 15/4221 |

FOREIGN PATENT DOCUMENTS

| | | | | |
|---|---|---|---|---|
| EP | 3741284 | A1 * | 11/2020 | A47L 15/4295 |
| WO | 2013132458 | A1 | 9/2013 | |
| WO | 2018228679 | A1 | 12/2018 | |
| WO | 2020249282 | A1 | 12/2020 | |

* cited by examiner

DOMESTIC DISHWASHER AND METHOD

CROSS-REFERENCES TO RELATED APPLICATIONS

This application is the U.S. National Stage of International Application No. PCT/EP2022/063518, filed May 19, 2022, which designated the United States and has been published as International Publication No. WO 2022/258337 A1 and which claims the priority of German Patent Application, Serial No. 10 2021 205 923.6, filed Jun. 11, 2021, pursuant to 35 U.S.C. 119 (a)-(d).

The contents of International Application No. PCT/EP2022/063518 and German Patent Application, Serial No. 10 2021 205 923.6 are incorporated herein by reference in their entireties as if fully set forth herein.

BACKGROUND OF THE INVENTION

The present invention relates to a household dishwasher and a method for operating the household dishwasher.

A dishwasher comprises a wash container for receiving washware. A number of washware receptacles can be provided in the wash container to receive the washware. The washware receptacles can be moved out of the wash container and back into it. A holding facility can be provided on such a washware receptacle to hold the washware. The holding facility is suitable for holding long-necked washware, such as refillable water bottles, drinks bottles, feeding bottles, vases or the like, upright in the washware receptacle, so that jets sprayed from a spray arm can enter the washware through an opening, for example through the neck of a bottle, to clean it.

The challenge for such washware in the form of bottles is for sufficient wash liquor and/or fresh water to pass from the spray arm into the interior of the bottle and for the bottom of the bottle to be cleaned adequately from the inside, particularly for tall bottles. The great diversity of bottle sizes and shapes available worldwide and the option for a user to position the holding facility freely in the washware receptacle also have to be taken into account.

In-house experience has shown that predetermined positioning and centering of the bottle neck allow it or a bottle opening to be positioned as directly as possible above a rotating spray arm. However this principle does not operate reliably if the user does not position the holding facility precisely as set out, does not position the washware precisely as set out, the size and shape of the washware do not correspond to the specifications or design of the holding facility and/or because of component tolerances of the spray system, washware receptacle and/or holding facility the jets are not sprayed precisely into the opening of the washware. All such instances can mean that the washware is not washed sufficiently clean. This applies in particular to the interior of the bottle from which not all residues can be removed in a clean and hygienic manner.

BRIEF SUMMARY OF THE INVENTION

Against this background one object of the present invention is to provide an improved household dishwasher.

A household dishwasher with a washware receptacle, a holding facility positioned in or on the washware receptacle to hold washware, an actively driven spray arm and an open-loop and closed-loop control facility is therefore proposed. The open-loop and closed-loop control facility is designed to influence a rotational movement of the spray arm as a function of a position of the holding facility in or on the washware receptacle so that the spray arm pauses close to the holding facility to apply wash liquor and/or fresh water to the washware held by the holding facility.

Because the spray arm pauses close to the holding facility, it is possible to direct the spray of wash liquor and/or fresh water into an opening of the washware. This always ensures reliable cleaning of the washware. It is therefore always possible to clean washware reliably and hygienically however the holding facility is positioned by the user, for any geometry of the washware, in particular even for very narrow bottle necks, regardless of component tolerances.

The household dishwasher comprises a wash container, in which a multiple washware receptacles, in particular a bottom washware receptacle or bottom rack, a top washware receptacle or top rack and a flatware drawer can be accommodated. Each washware receptacle can have one or more holding facilities. The washware receptacles can be pulled out of the wash container in a pull-out direction and be pushed back into the wash container in a push-in direction. However only one washware receptacle is examined in the following. The washware receptacle is in the form of a rack and made of a plurality of interconnected wires. The holding facility can have the geometry of a dome or spike. For example the holding facility can be clipped, latched or suspended in the washware receptacle.

That the spray arm is "actively driven" here means that the spray arm is assigned a drive element, in particular an electric motor, which drives the spray arm, in particular a boom of the spray arm. In contrast a "passively driven" spray arm has no drive element. A passively driven spray arm can be driven for example by wash liquor and/or fresh water expelled from spray nozzles in the spray arm. The boom is actively driven. In addition to the boom the spray arm can also have a spray arm satellite supported rotatably on the boom. In contrast to the boom the spray arm satellite is preferably passively driven. To this end the spray arm satellite can comprise drive nozzles, from which wash liquor and/or fresh water is/are expelled.

The open-loop and closed-loop control facility can be an open-loop and closed-loop control facility of the dishwasher. A wash program or multiple wash programs of the household dishwasher can be stored in the open-loop and closed-loop control facility. The open-loop and closed-loop control facility interacts with the drive element and can activate it. That the open-loop and closed-loop control facility "influences" the rotational movement of the spray arm or boom as a function of the position of the holding facility here can mean that the rotational movement is slowed, accelerated, reversed in respect of rotation direction and/or the spray arm or boom is halted.

That the spray arm pauses "close" to the holding facility here means in particular that the spray arm is positioned so that at least one circle of spray from spray nozzles of the spray arm intersects with an opening of the washware. That the spray arm "applies" wash liquor and/or fresh water to the washware here means in particular that the spray arm wets the washware with wash liquor and/or fresh water to clean it.

That the spray arm "pauses" here can mean in particular that the rotational movement of the spray arm is interrupted briefly and the spray arm stops for several fractions of a second to a number of seconds. "Pause" however also includes a simple reversal of rotation direction of the rotational movement, wherein the rotational movement is switched for example from rotation to the right to rotation to the left or vice versa. In the latter instance "pause" refers in particular specifically to the point in time when the rotation direction switch is made.

According to one embodiment the spray arm comprises a boom and a spray arm satellite supported rotatably on the boom, the open-loop and closed-loop control facility being designed to influence a rotational movement of the boom as a function of the position of the holding facility in or on the washware receptacle so that the spray arm satellite pauses close to the holding facility to apply wash liquor and/or fresh water to the washware held in the holding facility.

A household dishwasher with a washware receptacle, a holding facility positioned in or on the washware receptacle to hold washware, an actively driven spray arm, which comprises a boom and a spray arm satellite supported rotatably on the boom, and an open-loop and closed-loop control facility is therefore preferably proposed. The open-loop and closed-loop control facility here is designed to influence a rotational movement of the boom as a function of a position of the holding facility in or on the washware receptacle so that the spray arm satellite pauses close to the holding facility to apply wash liquor and/or fresh water to the washware held by the holding facility. In this context that the spray arm satellite "pauses" close to the holding facility means in particular that the spray arm satellite, as a rotating unit, is held in its current position relative to the holding facility briefly, for example for fractions of a second to several seconds, while the spray arm satellite itself continues to rotate. The boom in contrast is preferably stopped briefly. This means in particular that the boom with the rotating spray arm satellite pauses close to the holding facility to apply wash liquor and/or fresh water to the washware held by the holding facility. "Pause" therefore does not exclude the spray arm satellite itself continuing to rotate even during the pause.

According to a further embodiment the spray arm satellite pauses in multiple different positions, the spray arm satellite moving into the positions one after the other.

There is provision for example for three such different positions. However there can in principle be any number of positions. For example the spray arm satellite pauses for a few seconds in each position. The fact that there is provision for multiple positions ensures that sufficient wash liquor and/or fresh water enters the washware through the opening to clean it adequately.

According to a further embodiment the spray arm satellite pauses in a first end position and in a second end position that is different from the first end position, the spray arm satellite moving to and fro between the end positions.

For example the spray arm satellite remains in the respective end position for a few seconds. Between the two end positions the spray arm satellite moves to and fro in a wiping movement.

According to a further embodiment the household dishwasher is designed to detect the positions of the holding facility.

To this end the household dishwasher can have corresponding detectors or sensors.

According to a further embodiment the household dishwasher comprises a position sensor and/or camera to detect the position of the holding facility.

The position sensor can be a magnetic sensor for example. The position sensor can be positioned on the wash container or on the washware receptacle. The camera can also be positioned on the wash container or on the washware receptacle. Detection of the position of the holding facility can also take place by way of frictional contact, a carrier pin or the like. Determination of the position of the holding facility can also take place by way of a load interrogation of the rotating spray arm, in particular the drive element, and an associated local load change at the holding facility, for example by way of magnetic force.

According to a further embodiment the household dishwasher interacts with an external mobile device to detect the position of the holding facility.

The external mobile device can be a mobile phone, in particular a smartphone, tablet or the like, for example. Determination of the position of the holding facility can take place for example by the user inputting the position of the holding facility by way of a mobile app of the mobile device. Automated optical detection can also take place with the aid of the mobile device, in particular with the aid of a camera of the mobile device. Camera data of the mobile device can also serve for load detection for the washware receptacle.

According to a further embodiment any position can be selected for the holding facility in or on the washware receptacle.

In other words the user can position the holding facility at any point in or on the washware receptacle. For example the holding facility is suspended, latched or clipped in the washware receptacle. Alternatively the holding facility or multiple holding facilities can also be integrated in a fixed manner on the washware receptacle.

According to a further embodiment the household dishwasher comprises a drive element for driving the boom, the open-loop and closed-loop control facility being designed to activate the drive element to influence the rotational movement of the spray arm.

In particular the open-loop and closed-loop control facility is designed to activate the drive element to influence the rotational movement of the spray arm. As mentioned above, the drive element can be an electric motor. For example the open-loop and closed-loop control facility can activate or regulate a speed of the drive element in any manner. The open-loop and closed-loop control facility can also change a rotation direction of the drive element in any manner. The open-loop and closed-loop control facility can also stop or block the drive element to halt the spray arm satellite.

A method for operating a household dishwasher with a washware receptacle, a holding facility positioned in or on the washware receptacle to hold washware, an actively driven spray arm and an open-loop and closed-loop control facility is also proposed. The method comprises the following steps: a) detecting a position of the holding facility in or on the washware receptacle and b) influencing a rotational movement of the spray arm with the aid of the open-loop and closed-loop control facility as a function of the position of the holding facility so that the spray arm pauses close to the holding facility so that wash liquor and/or fresh water is/are applied to the washware held by the holding facility.

The pausing of the spray arm or just the spray arm satellite can take place for example once or multiple times during a wash program. The detection or capturing of the position of the holding facility in or on the washware receptacle can take place with the aid of the above-mentioned mobile device, the position sensor and/or camera. The open-loop and closed-loop control facility communicates with the mobile device, position sensor and/or camera. Corresponding interfaces can be provided for this purpose. Communication can be wireless or wire-based. Influencing of the rotational movement of the boom takes place as a function of the data relating to the position of the holding facility provided by the mobile device, position sensor and/or camera.

According to one embodiment the spray arm comprises a boom and a spray arm satellite supported rotatably on the boom, a rotational movement of the boom being influenced with the aid of the open-loop and closed-loop control facility as a function of the position of the holding facility in step b) so that the spray arm satellite pauses close to the holding facility so that wash liquor and/or fresh water is/are applied to the washware held by the holding facility.

In other words a method for operating a household dishwasher with a washware receptacle, a holding facility positioned in or on the washware receptacle to hold washware, an actively driven spray arm, which comprises a boom and a spray arm satellite supported rotatably on the boom, and an open-loop and closed-loop control facility is preferably proposed. The method therefore comprises the following steps: a) detecting a position of the holding facility in or on the washware receptacle and b) influencing a rotational movement of the spray arm with the aid of the open-loop and closed-loop control facility as a function of the position of the holding facility so that the spray arm satellite pauses close to the holding facility so that wash liquor and/or fresh water is/are applied to the washware held by the holding facility.

According to a further embodiment the spray arm satellite pauses in multiple different positions, the spray arm satellite being moved into the positions one after the other.

According to a further embodiment the spray arm satellite pauses in a first end position and in a second end position that is different from the first end position, the spray arm satellite being moved to and fro between the end positions.

The two operating states cited above, in which the spray arm satellite either pauses in the multiple different positions or in which the spray arm satellite moves to and fro between the first end position and the second end position, can be selected for example by a corresponding selection of a wash or cleaning program.

Further possible implementations of the household dishwasher and/or method comprise combinations of features or embodiments described above or in the following with regard to the exemplary embodiments even if these are not cited specifically. The person skilled in the art will also add individual aspects to improve or complete the respective basic form of the household dishwasher and/or method.

BRIEF DESCRIPTION OF THE DRAWINGS

Further advantageous configurations and aspects of the household dishwasher and/or method are set out in the subclaims and the exemplary embodiments of the household dishwasher and/or method described in the following. The household dishwasher and/or method is/are also described in more detail based on preferred embodiments with reference to the accompanying figures.

DETAILED DESCRIPTION OF EXEMPLARY EMBODIMENTS OF THE PRESENT INVENTION

Figure 1:
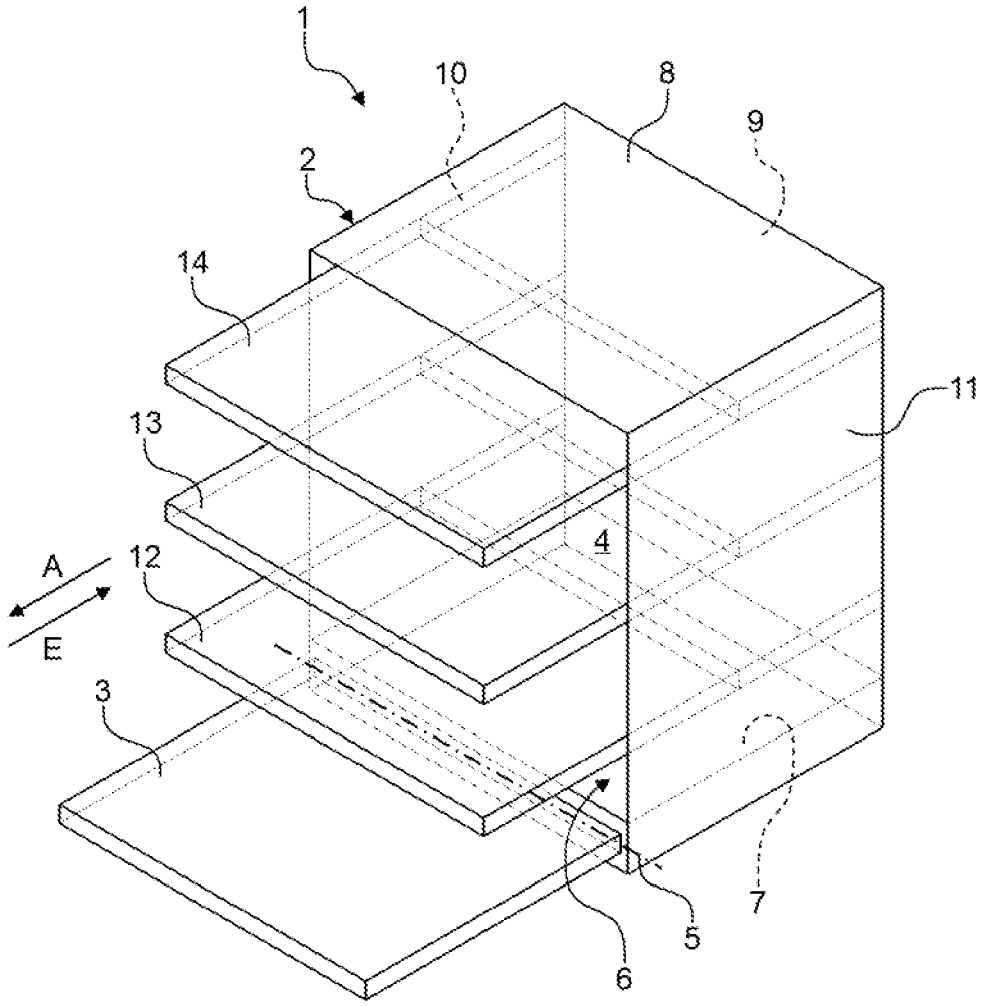
FIG. 1 shows a schematic perspective view of an embodiment of a household dishwasher.

Identical elements or those of identical function are shown with the same reference characters in the figures, unless otherwise specified.

FIG. 1 shows a schematic perspective view of an embodiment of a household dishwasher 1. The household dishwasher 1 comprises a wash container 2, which can be closed, in particular in a water-tight manner, by a door 3. To this end a sealing facility can be provided between the door 3 and the wash container 2. The wash container 2 is preferably box-shaped. The wash container 2 can be arranged in a housing of the household dishwasher 1. The wash container 2 and door 3 can form a wash chamber 4 for washing washware.

The door 3 is shown in its opened position in FIG. 1. The door 3 can be closed or opened by pivoting about a pivot axis 5 provided at a lower end of the door 3. A loading opening 6 of the wash container 2 can be closed or opened with the aid of the door 3. The wash container 2 has a base 7, a top 8 positioned opposite the base 7, a rear wall 9 positioned opposite the closed door 3 and two opposing side walls 10, 11. The base 7, top 8, rear wall 9 and side walls 10, 11 can be made of stainless steel sheet for example. Alternatively the base 7 for example can be made of a plastic material.

The household dishwasher 1 also has at least one washware receptacle 12 to 14. Multiple, for example three, washware receptacles 12 to 14 are preferably provided, the washware receptacle 12 being a bottom washware receptacle or bottom rack, the washware receptacle 13 a top washware receptacle or top rack and the washware receptacle 14 a flatware drawer. As also shown in FIG. 1, the washware receptacles 12 to 14 are arranged one above the other in the wash container 2. Each washware receptacle 12 to 14 can be moved into or out of the wash container 2 as required. In particular each washware receptacle 12 to 14 can be pushed or moved into the wash container 2 in a push-in direction E and be pulled or moved out of the wash container 2 in a pull-out direction A counter to the push-in direction E.

Figure 2:
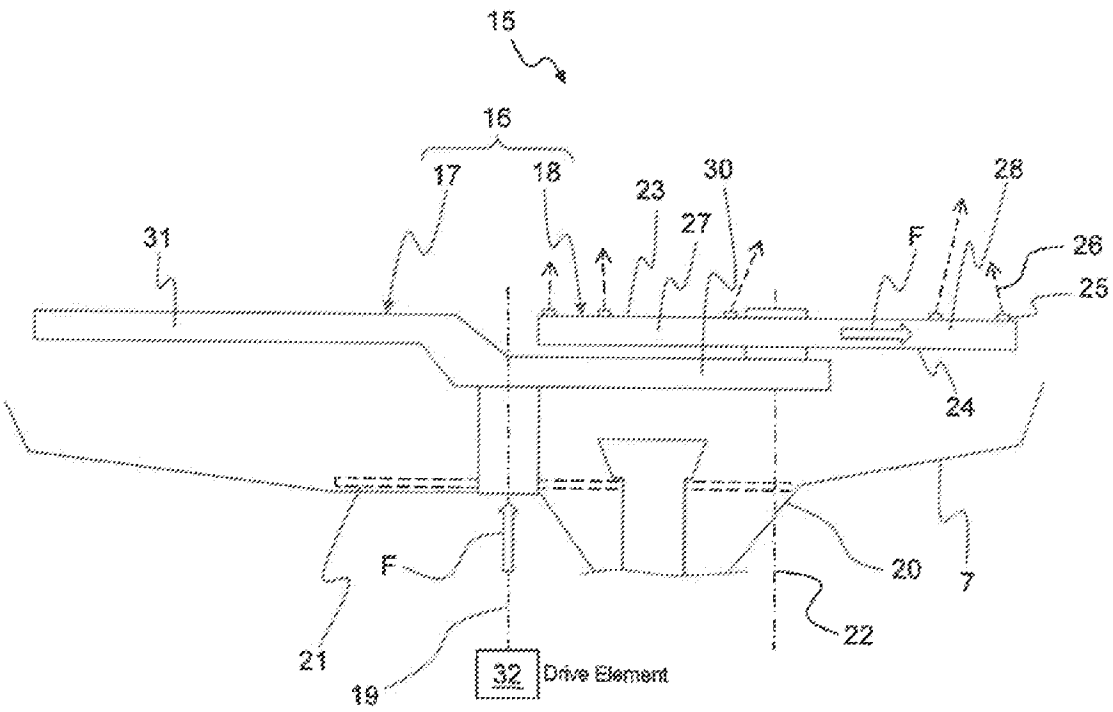
FIG. 2 shows a schematic side view of an embodiment of a spray device for the household dishwasher from FIG. 1.

FIG. 2 shows a schematic side view of an embodiment of a spray device 15 for the household dishwasher 1. The spray device 15 is preferably provided on the base 7 of the wash container 2. The spray device 15 comprises a rotatably supported spray arm 16 with a boom 17 and a spray arm satellite 18 supported rotatably on the boom 17. The boom 17 is supported on a sump 20 of the household dishwasher 1 in such a manner that it can rotate about a first rotation axis 19. The sump 20 is provided on the base 7. The sump 20 is covered by a filter system 21. The filter system 21 can comprise a coarse filter and a fine filter. The fine filter is a surface strainer or can be referred to as a surface strainer.

The spray arm satellite 18 is supported on the boom 17 in such a manner that it can rotate about a second rotation axis 22. The rotation axes 19, 22 are arranged parallel to one another and at a distance from one another. The spray arm satellite 18 has an upper face 23 facing away from the base 7 and a lower face 24 facing the base 7. Provided on the upper face 23 is a plurality of spray nozzles 25, which face away from the base 7 and toward the top 8. In FIG. 2 only one of the spray nozzles 25 is shown with a reference character.

The spray nozzles 25 are able to generate jets 26, which can be used to apply wash liquor and/or fresh water F to the washware (not shown). In particular the spray nozzles 25 are only provided on the top of the spray arm satellite 18. Alternatively the spray nozzles 25 can also be arranged so that they point in the direction of the base 7. The spray arm satellite 18 can also have spray nozzles 25 on the top and bottom.

Figure 4:
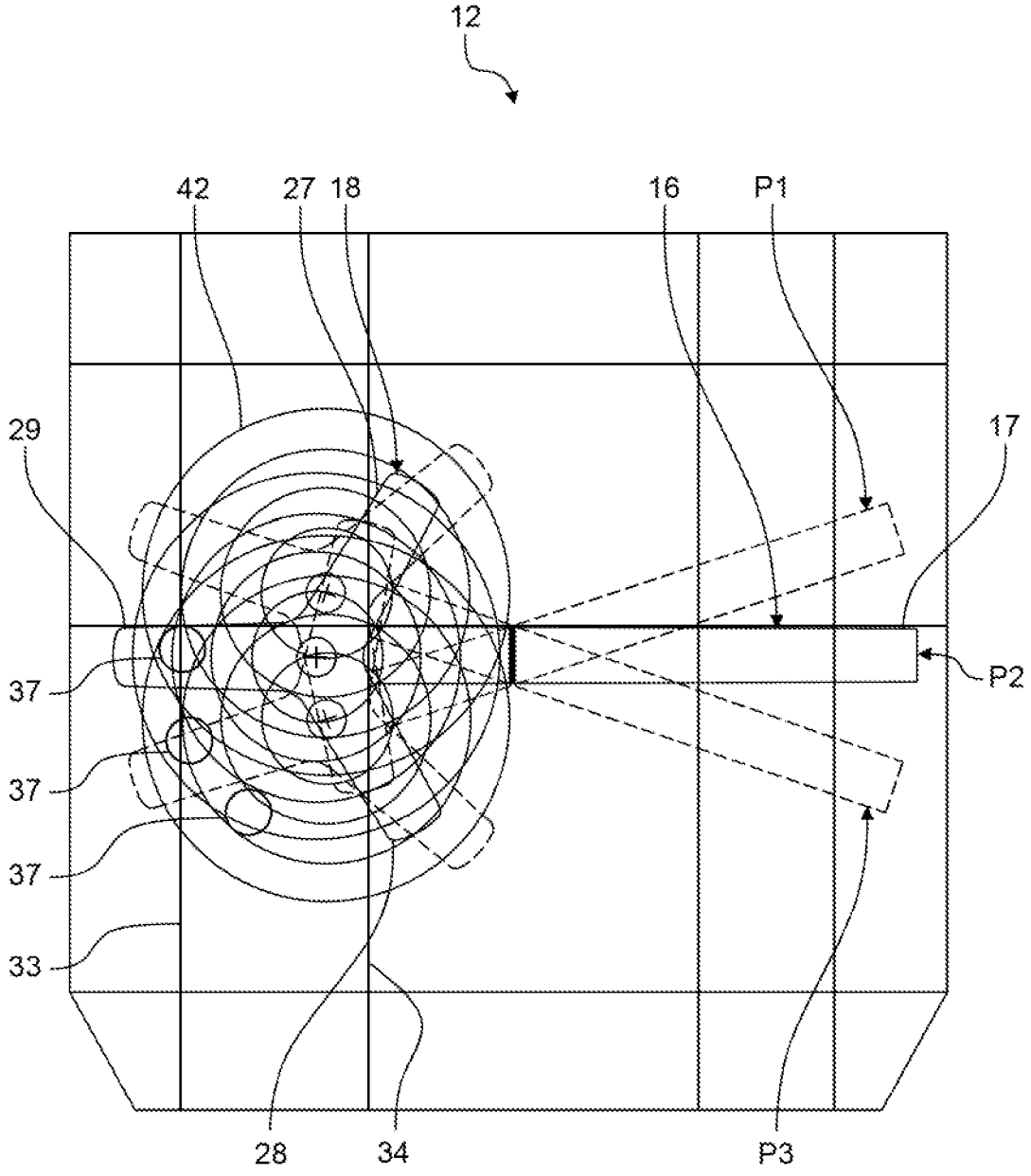
FIG. 4 shows a further schematic top view of the washware receptacle from FIG. 3.

The spray arm satellite 18 has multiple arms 27 to 29 (FIG. 4). There can be any number of arms 27 to 29. By way of example three such arms 27 to 29 are provided, being arranged at an angle of 120° from each other.

The boom 17 comprises a first arm 30, on which the spray arm satellite 18 is supported in such a manner that it can rotate about the second rotation axis 22. The boom 17 also comprises a second arm 31. The first arm 30 and the second arm 31 are arranged at different heights when viewed along the first rotation axis 19. In particular the first arm 30 is closer to the base 7 than the second arm 31.

The boom 17 can also have additional spray nozzles but this is not essential. The boom 17 is actively driven. "Actively driven" here means that the spray arm 16, in particular the boom 17, is assigned a drive element 32, for example comprising an electric motor. The drive element 32 is able to cause the boom 17 to rotate about the first rotation axis 19.

In contrast the spray arm satellite 18 is not actively driven. In particular the spray arm satellite 18 is caused to rotate by the spray jets 26 expelled from the spray nozzles 25. Specific drive spray nozzles can also be provided on the spray arm satellite 18.

Figure 3:
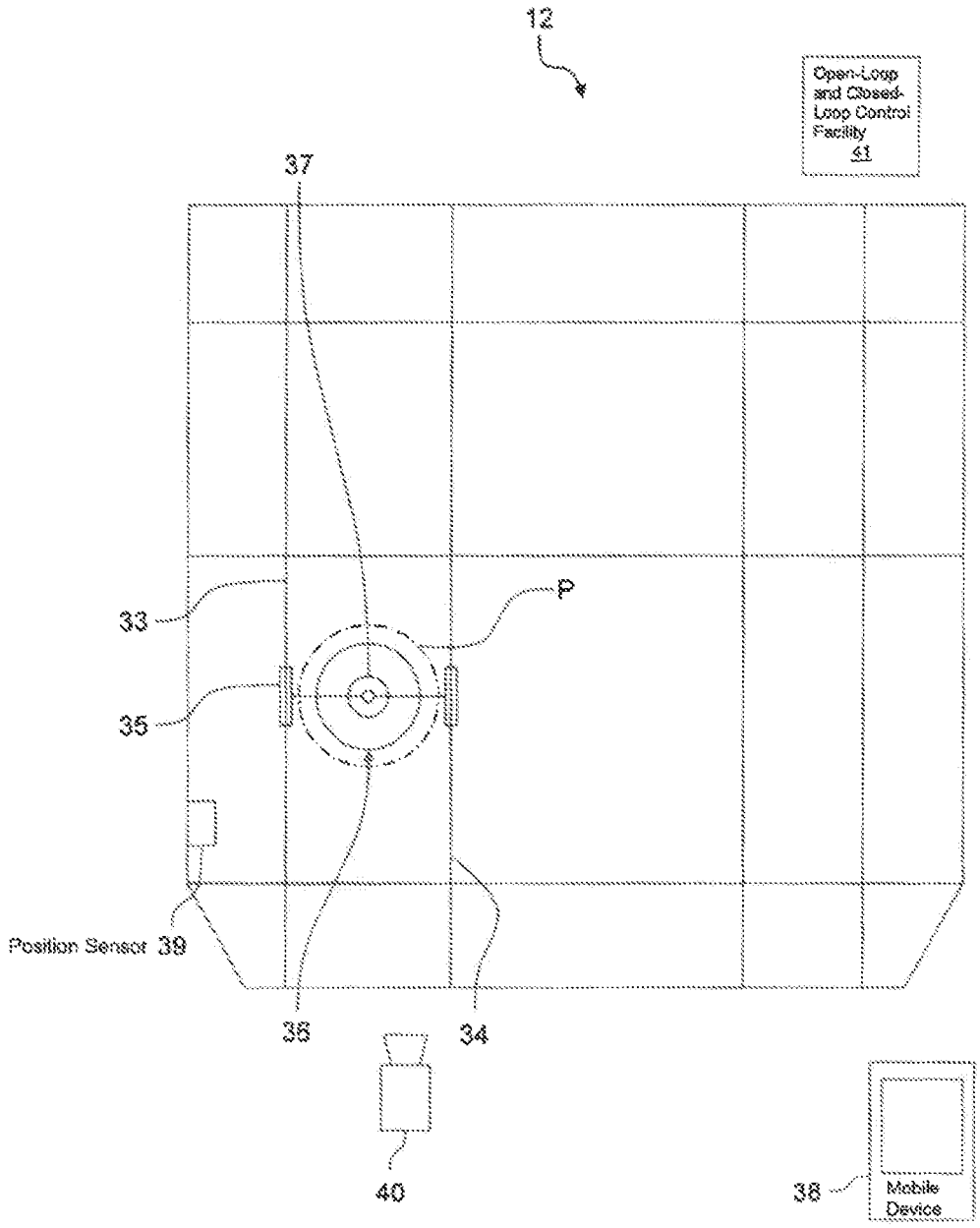
FIG. 3 shows a schematic top view of an embodiment of a washware receptacle for the household dishwasher from FIG. 1.

FIG. 3 shows a schematic top view of an embodiment of the washware receptacle 12. The washware receptacles 13, 14 can be identical in structure to the washware receptacle 12. Only the washware receptacle 12 is examined in the following however. All the details relating to the washware receptacle 12 can however be applied correspondingly to the washware receptacles 13, 14. The orientation of FIG. 3 means that the spray device 15 or the spray arm 16 is arranged below the washware receptacle 12. The spray device 15 is however not shown in FIG. 3.

The washware receptacle 12 is made of a plurality of wires 33, 34, which are connected, for example welded, together. FIG. 3 only shows two parallel wires 33, 34, each with a reference character. The washware receptacle 12 has a holding facility 35. The holding facility 35 is able to hold washware 36, such as refillable water bottles, drinks bottles, feeding bottles, vases or the like, upright in the washware receptacle 12, so that the spray jets 26 can enter the washware 36 through an opening 37, for example through the neck of a bottle, to clean it. The washware 36 in particular comprises bottles with narrow necks.

The challenge for such washware 36 in the form of bottles is for sufficient wash liquor and/or fresh water F to pass from the spray arm 16 into the interior of the bottle and for the bottom of the bottle to be cleaned adequately from the inside, particularly for tall bottles. The great diversity of bottle sizes and shapes available worldwide and the option for a user to position the washware 36 and/or the holding facility 35 freely in the washware receptacle 12 also have to be taken into account.

The holding facility 35 can be a bottle holder. The holding facility 35 can also be referred to as a holding and/or centering aid. The holding facility 35 itself can be positioned by the user in any position in or on the washware receptacle 12 and be removed again therefrom. For example the holding facility 35 is suspended, latched or clipped in the wires 33, 34. Alternatively the holding facility 35 or multiple holding facilities 35 can be mounted in fixed positions on the washware receptacle 12. The holding facility 35 can have a spike-type geometry, which can be inserted into the opening 37 in the washware 36 to hold the washware 36 upright in the washware receptacle 12.

The household dishwasher 1 is able to detect the position P of the holding facility 35 in or on the washware receptacle 12. The position P is shown with a dot/dash circle in FIG. 3. The position P here can therefore refer to a region in which the holding facility 35 is located. Position can be determined for example by the user inputting the position P of the holding facility 35 by way of a control panel of the household dishwasher 1 or by way of a mobile app of a mobile device 38. The mobile device 38 can be for example a mobile phone, in particular a smart phone, or a tablet.

Alternatively the position P of the holding facility 35 can also be detected in an automated manner. This can take place for example with the aid of a position sensor 39, in particular a magnetic sensor. Optical detection is also possible. Optical detection can take place for example with the aid of a camera 40, which can also be used to detect the load in the washware receptacle 12. Optical detection can also take place with the aid of the mobile device 38, in particular a camera of the mobile device 38. The camera data of the mobile device 38 can also be used for load detection.

Detection of the position P of the holding facility 35 can also take place by way of a load interrogation of the rotating spray arm 16, in particular the drive element 32, and an associated local load change at the holding facility 35, for example by way of magnetic force, frictional contact, a carrier pin or the like.

To evaluate data from the mobile device 38, position sensor 39 and/or camera 40, the household dishwasher 1 comprises an open-loop and closed-loop control facility 41, which communicates with the mobile device 38, position sensor 39 and/or camera 40. The open-loop and closed-loop control facility 41 is also able to activate the spray device 15, in particular the drive element 32 of the spray device 15. It is thus possible to control for example a speed, rotation velocity and/or rotation direction of the boom 17 with the aid of the open-loop and closed-loop control facility 41.

FIG. 4 shows a further schematic top view of the washware receptacle 12. As mentioned above, the spray arm 16 is located below the washware receptacle 12. The spray arm 16 is shown in three different angular positions or positions P1, P2, P3 in FIG. 4.

In order to be able to apply sufficient wash liquor and/or fresh water F to the washware 36, the drive element 32 is activated by the open-loop and closed-loop control facility 41 so that the spray arm 16, in particular the boom 17, stops in each of the multiple different positions P1, P2, P3, while the spray arm satellite 18 continues to rotate. Three positions P1, P2, P3 are provided by way of example. However there can in principle be any number of positions P1, P2, P3. The different positions P1, P2, P3 can each be held for a few seconds.

Positions P1, P2, P3 can be taken once during a wash program or multiple times in different phases of the wash program. Active circles 42, of which only one is shown with a reference character in FIG. 4, of the spray jets 26 intersect for different positions P of the holding facility 35 (not shown) at least once with the opening 37 of the washware 36 so that sufficient wash liquor and/or fresh water F enters the washware 36 to clean it. The opening 37 is shown for three different positions P of the holding facility 35 in FIG. 4.

Figure 5:
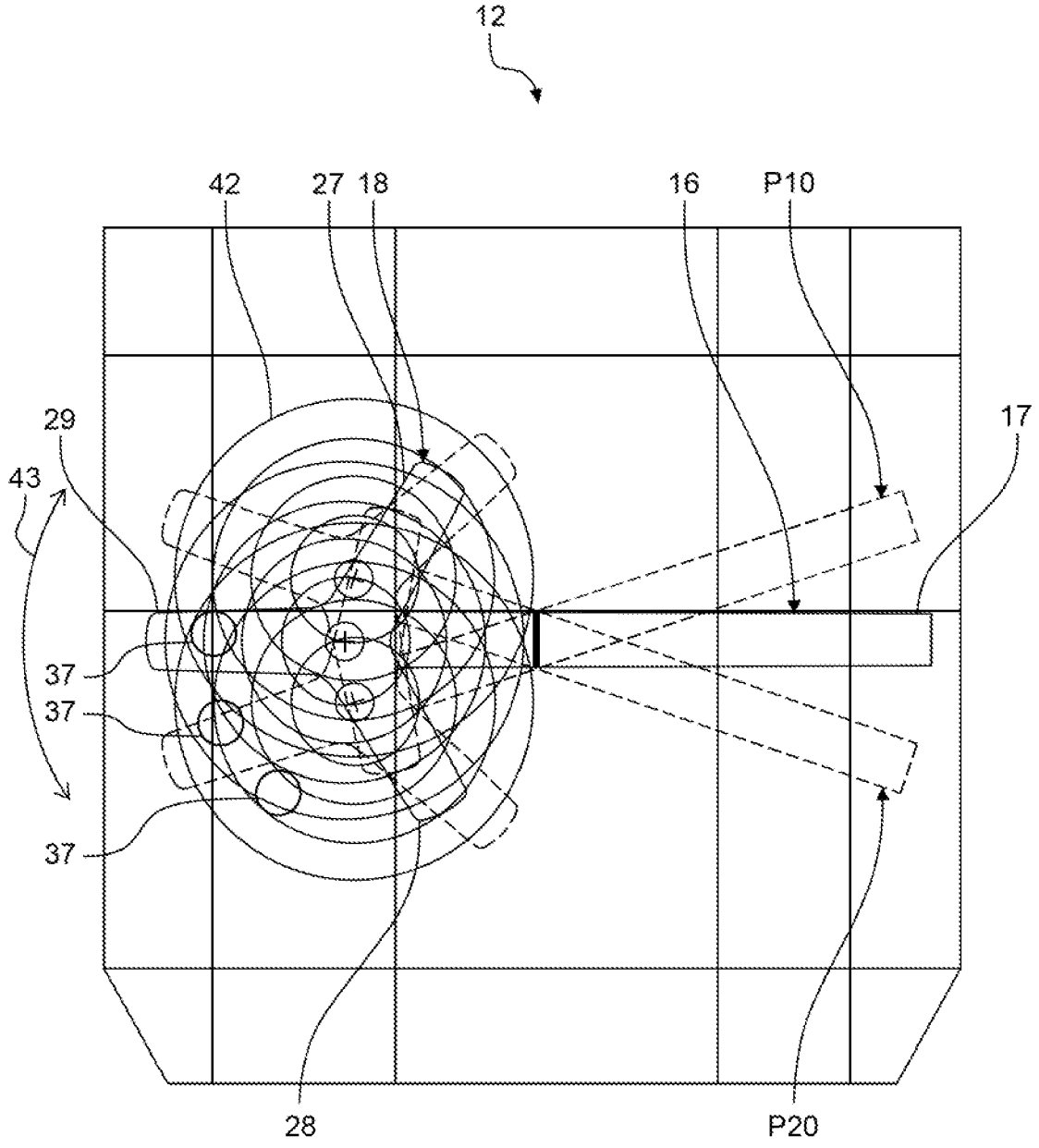
FIG. 5 shows a further schematic top view of the washware receptacle from FIG. 3.

FIG. 5 shows a further schematic top view of the washware receptacle 12. In contrast to FIG. 4 the spray arm satellite 18 does not stop in different positions P1, P2, P3 here but moves to and fro in a wiping movement between two end positions P10, P20, as shown with a double arrow 43. This is brought about by corresponding activation of the drive element 32 with the aid of the open-loop and closed-loop control facility 41. The active circles 42 of the spray arm satellite 18 achieve a good overlap with the opening 37 here too.

The specific activation of the spray arm 16 based on the detected position P of the holding facility 35 therefore allows full rinsing out and cleaning of the interior of the washware 36. This is achieved regardless of where the user positions the holding facility 35 on or in the washware receptacle 12. Any geometry of the washware 36 can be cleaned reliably, in particular even bottles with a very narrow neck. The cleaning result does not depend on component tolerances of the holding facility 35. A clean and hygienic cleaning result can always be reliably achieved.

Figure 6:
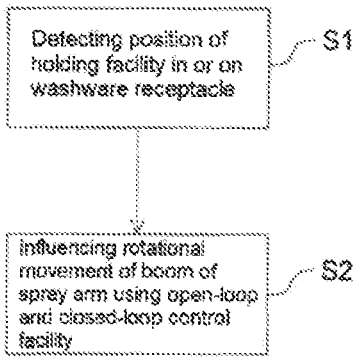
FIG. 6 shows a schematic block diagram of an embodiment of a method for operating the household dishwasher from FIG. 1.

FIG. 6 shows a schematic block diagram of an embodiment of a method for operating the household dishwasher 1. With the method in a step S1 the position P of the holding facility 35 in or on the washware receptacle 12 is detected or captured. Detection can take place with the aid of the mobile device 38, position sensor 39 and/or camera 40. Evaluation of the captured data can be dealt with by the open-loop and closed-loop control facility 41.

In a step S2 the rotational movement of the boom 17 is influenced or activated with the aid of the open-loop and closed-loop control facility 41 as a function of the detected position P of the holding facility 35 so that the spray arm satellite 18 pauses close to the holding facility 35, so that wash liquor and/or fresh water F is applied to the washware 36 held by the holding facility 35. In particular in step S2 the wash liquor and/or fresh water F is introduced into the washware 36 by way of the opening 37.

Although the present invention has been described with reference to exemplary embodiments, it can be modified in many different ways.

The invention claimed is:

1. A household dishwasher, comprising:

a washware receptacle;

a holding facility positioned in or on the washware receptacle to hold washware;

an actively driven spray arm that comprises a spray arm satellite; and an open-loop and closed-loop control facility designed to influence a rotational movement of the spray arm as a function of a position of the holding facility in or on the washware receptacle so that the spray arm satellite moves to and fro between a first end position of the holding facility and a second end position of the holding facility to apply wash liquor and/or fresh water to the washware held by the holding facility.

2. The household dishwasher of claim 1, wherein the spray arm further comprises a boom, wherein the spray arm satellite is supported rotatably on the boom, said open-loop and closed-loop control facility designed to influence a rotational movement of the boom as a function of the position of the holding facility in or on the washware receptacle so that the spray arm satellite moves to and fro between the first end position and the second end position to apply wash liquor and/or fresh water to the washware held by the holding facility.

3. The household dishwasher of claim 2, wherein the spray arm satellite pauses in multiple different positions, with the spray arm satellite capable of moving into the different positions one after the other.

4. The household dishwasher of claim 1, wherein the household dishwasher is designed to detect the position of the holding facility.

5. The household dishwasher of claim 4, further comprising a position sensor and/or camera to detect the position of the holding facility.

6. The household dishwasher of claim 4, wherein the household dishwasher interacts with an external mobile device to detect the position of the holding facility.

7. The household dishwasher of claim 1, wherein the holding facility is designed such that any position of the holding facility in or on the washware receptacle is selectable.

8. The household dishwasher of claim 1, further comprising a drive element designed to drive a boom, said open-loop and closed-loop control facility designed to activate the drive element to influence the rotational movement of the spray arm.

9. A method for operating a household dishwasher which comprises a washware receptacle, a holding facility positioned in or on the washware receptacle to hold washware, an actively driven spray arm that includes a spray arm satellite, and an open-loop and closed-loop control facility, said method comprising:

a) detecting a position of the holding facility in or on the washware receptacle; and b) influencing a rotational movement of the spray arm with the aid of the open-loop and closed-loop control facility as a function of the position of the holding facility such that the spray arm satellite moves to and fro between a first end position of the holding facility and a second end position of the holding facility so as to apply wash liquor and/or fresh water to the washware held by the holding facility.

10. The method of claim 9, wherein the spray arm further comprises a boom, and wherein the spray arm satellite is supported rotatably on the boom, said method further comprising influencing a rotational movement of the boom with the aid of the open-loop and closed-loop control facility as a function of the position of the holding facility in step b) such that the spray arm satellite moves to and fro between the first end position and the second end position so as to apply wash liquor and/or fresh water to the washware held by the holding facility.

11. The method of claim 10, further comprising:

designing the spray arm satellite to be able to pause in multiple different positions; and moving the spray arm satellite into the different positions one after the other.

* * * * *